US010510301B2

(12) United States Patent
Na et al.

(10) Patent No.: US 10,510,301 B2
(45) Date of Patent: Dec. 17, 2019

(54) SCAN DRIVER AND DISPLAY APPARATUS HAVING THE SAME

(71) Applicant: SAMSUNG DISPLAY CO., LTD., Yongin-si, Gyeonggi-do (KR)

(72) Inventors: Ji-Su Na, Yongin-si (KR); Ji-Hye Kong, Seongnam-si (KR); Young-In Hwang, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/452,862

(22) Filed: Mar. 8, 2017

(65) Prior Publication Data

US 2017/0263188 A1 Sep. 14, 2017

(30) Foreign Application Priority Data

Mar. 9, 2016 (KR) ..... 10-2016-0028287

(51) Int. Cl.

*G09G 3/36* (2006.01)
*G09G 3/3266* (2016.01)
*G09G 3/3258* (2016.01)

(52) U.S. Cl.

CPC ..... *G09G 3/3266* (2013.01); *G09G 3/3258* (2013.01); *G09G 3/3674* (2013.01); *G09G 3/3677* (2013.01); *G09G 2300/043* (2013.01); *G09G 2300/0809* (2013.01); *G09G 2300/0861* (2013.01); *G09G 2310/08* (2013.01); *G09G 2320/045* (2013.01)

(58) Field of Classification Search

CPC .. G09G 3/3258; G09G 3/3266; G09G 3/3674; G09G 3/3677; G09G 2300/0408; G09G 2300/0426; G09G 2300/0809; G09G 2310/0283; G09G 2310/0286; G09G 2310/0291; G09G 2310/061; G09G 2310/063; G09G 2310/08; G09G 2330/021; G11C 19/28

See application file for complete search history.

(56) References Cited

U.S. PATENT DOCUMENTS

| | | | | |
|---|---|---|---|---|
| 9,336,735 | B2 * | 5/2016 | Abe | G09G 3/3677 |
| 9,336,899 | B2 * | 5/2016 | Ochiai | G11C 19/287 |
| 9,406,399 | B2 * | 8/2016 | Ochiai | G09G 3/3677 |
| 9,430,981 | B2 * | 8/2016 | Li | G09G 3/3677 |
| 9,793,007 | B2 * | 10/2017 | Ochiai | G11C 19/287 |
| 9,818,345 | B2 * | 11/2017 | Shim | G09G 3/3258 |
| 9,881,691 | B2 * | 1/2018 | Ochiai | G09G 3/3677 |
| 2003/0043104 | A1 * | 3/2003 | Lee | G02F 1/1345 345/92 |
| 2003/0117352 | A1 * | 6/2003 | Kimura | G09G 3/3233 345/87 |
| 2005/0156832 | A1 * | 7/2005 | Ono | G09G 3/3258 345/76 |

(Continued)

FOREIGN PATENT DOCUMENTS

| | | |
|---|---|---|
| KR | 10-2012-0019227 A | 3/2012 |
| KR | 10-2015-0025539 A | 3/2015 |

*Primary Examiner* — Michael J Eurice

(74) *Attorney, Agent, or Firm* — Kile Park Reed & Houtteman PLLC

(57) ABSTRACT

A scan driver is integrated to include multiple drivers in a peripheral area of a display. The drivers output gate, emission, and/or other signals for driving pixel circuits in the display based on one or more clock signals.

20 Claims, 5 Drawing Sheets

(56) References Cited

U.S. PATENT DOCUMENTS

2006/0071890 A1* 4/2006 Kikuchi ..... G09G 3/3677 345/87
2006/0114216 A1* 6/2006 Shim ..... G09G 3/3677 345/100
2006/0145964 A1* 7/2006 Park ..... G09G 3/3233 345/76
2006/0244387 A1* 11/2006 Park ..... G09G 3/3233 315/169.1
2008/0002803 A1* 1/2008 Kim ..... G09G 3/006 377/64
2008/0043005 A1* 2/2008 Kanda ..... G09G 3/3233 345/204
2009/0195527 A1* 8/2009 Yamamoto ..... G09G 3/3233 345/211
2009/0225068 A1* 9/2009 Jeong ..... G09G 3/3266 345/211
2010/0315403 A1* 12/2010 Kaneyoshi ..... G09G 3/3614 345/211
2011/0310074 A1* 12/2011 Ochiai ..... G09G 3/3674 345/208
2011/0316831 A1* 12/2011 Ochiai ..... G09G 3/3677 345/208
2012/0170707 A1* 7/2012 Hsu ..... G09G 3/3677 377/79
2014/0152644 A1* 6/2014 Abe ..... G09G 3/3677 345/213
2014/0253424 A1* 9/2014 Yu ..... G11C 19/28 345/100
2014/0320386 A1* 10/2014 Li ..... G09G 3/3677 345/87
2015/0084946 A1* 3/2015 Shim ..... G09G 3/3258 345/212
2015/0332649 A1* 11/2015 Ko ..... G11C 19/00 377/64
2017/0061922 A1* 3/2017 Wang ..... G11C 19/184
2017/0115802 A1* 4/2017 Sun ..... G06F 3/0416
2017/0193921 A1* 7/2017 Sung ..... G09G 3/3258
2017/0263188 A1* 9/2017 Na ..... G09G 3/3258
2017/0287424 A1* 10/2017 Wu ..... G09G 3/3674
2017/0337876 A1* 11/2017 Kim ..... G09G 3/3225
2017/0337877 A1* 11/2017 Kim ..... G09G 3/3225
2018/0261176 A1* 9/2018 Li ..... G09G 3/3659

* cited by examiner

SCAN DRIVER AND DISPLAY APPARATUS HAVING THE SAME

CROSS-REFERENCE TO RELATED APPLICATION

Korean Patent Application No. 10-2016-0028287, filed on Mar. 9, 2016, and entitled, "Scan Driver and Display Apparatus Having the Same," is incorporated by reference herein in its entirety.

BACKGROUND

1. Field

One or more embodiments described herein relate to a scan driver and a display apparatus having a scan driver.

2. Description of the Related Art

An organic light emitting display (OLED) device has a relatively rapid response speed and low power consumption. Such a display device has a plurality of drivers for driving pixel circuits in a display panel. Each pixel circuit includes a plurality of transistors for driving an OLED. The drivers include a data driver for driving data lines, a gate driver for driving gate lines, and an emission driver driving emission control lines. The size and cost of the display may be increased when the drivers are mounted in a peripheral area of the display panel.

SUMMARY

In accordance with one or more embodiments, a scan driver includes a first signal generator includes: a first T1 transistor to apply an (n−1)-th gate signal to a first control node based on a first clock signal, a second T1 transistor to output an n-th gate signal synchronized with the second clock signal based on a voltage of the first control node, a third T1 transistor to apply a first gate voltage to a second control node based on the first clock signal, and a fourth T1 transistor to output a second gate voltage as the n-th gate signal based on a voltage of the second control node (n is a natural number); and a second signal generator including: a first T2 transistor to apply an (n−1)-th compensation control signal to a third control node based on a third clock signal, a second T2 transistor to output the first gate voltage as an n-th compensation control signal based on a voltage of the third control node, a third T2 transistor to apply the first gate voltage to a fourth control node based on the second clock signal, and a fourth T2 transistor to output the second gate voltage as the n-th compensation control signal based on a voltage of the fourth control node.

The second signal generator may include a fifth T2 transistor to apply the second gate voltage to the third control node based on the second clock signal; and a sixth T2 transistor to apply the second gate voltage to the fourth control node based on the (n−1)-th compensation control signal. The first signal generator may include a fifth T1 transistor to apply the first clock signal to the second control node based on a voltage of the first control node; a sixth T1 transistor to be driven based on the second clock signal; a seventh T1 transistor to be driven based on a voltage of the second control node; and an eighth T1 transistor to be driven based on the first clock signal.

The scan driver may include a third signal generator to generate an n-th emission control signal based on the n-th gate signal. The third signal generator may includes a first T3 transistor to apply the n-th gate signal to a fifth control node based on a fourth clock signal, a second T3 transistor to output the first gate voltage as the n-th emission control signal based on a voltage of the fifth control node, and a third T3 transistor to output the second gate voltage as the n-th emission control signal based on the n-th gate signal. The third signal generator may include a fourth T3 transistor to apply the second gate voltage to the fifth control node based on the n-th gate signal.

The second clock signal may be delayed by one horizontal period from the first clock signal, the third clock signal may be delayed by one horizontal period from the second clock signal, the fourth clock signal may be delayed by one horizontal period from the third clock signal, and the first clock signal may be delayed by one horizontal period from the fourth clock signal.

An (n−1)-th circuit stage may generate an (n−1)-th gate signal synchronized with the first clock signal, an n-th circuit stage may generate an n-th gate signal synchronized with the second clock signal, an (n+1)-th circuit stage may generate an (n+1)-th gate signal synchronized with the third clock signal, and an (n+2)-th circuit stage may generate an (n+2)-th gate signal synchronized with the fourth clock signal.

In accordance with one or more other embodiments, a display apparatus includes a display panel including a plurality of pixel circuits on a display area; and a scan driver on a peripheral area surrounding the display area, the scan driver including a plurality of circuit stages to output plurality of gate signals, a plurality of emission control signals, and a plurality of compensation control signals, wherein an n-th circuit stage of the plurality of circuit stages includes a first signal generator which includes: a first T1 transistor to apply an (n−1)-th gate signal to a first control node based on a first clock signal, a second T1 transistor to output an n-th gate signal synchronized with the second clock signal based on a voltage of the first control node, a third T1 transistor to apply a first gate voltage to a second control node based on the first clock signal, and a fourth T1 transistor to output a second gate voltage as the n-th gate signal based on a voltage of the second control node (n' is a natural number), and a second signal generator which includes: a first T2 transistor to apply an (n−1)-th compensation control signal to a third control node based on a third clock signal, a second T2 transistor to output the first gate voltage as an n-th compensation control signal based on a voltage of the third control node, a third T2 transistor to apply the first gate voltage to a fourth control node based on the second clock signal, and a fourth T2 transistor to output the second gate voltage as the n-th compensation control signal based on a voltage of the fourth control node.

The second signal generator may include a fifth T2 transistor to apply the second gate voltage to the third control node based on the second clock signal; and a sixth T2 transistor to apply the second gate voltage to the fourth control node based on the (n−1)-th compensation control signal. The first signal generator may include a fifth T1 transistor to apply the first clock signal to the second control node based on a voltage of the first control node; a sixth T1 transistor to be driven based on the second clock signal; a seventh T1 transistor to be driven based on a voltage of the second control node; and a eighth T1 transistor to be driven based on the first clock signal.

The n-th circuit stage may include a third signal generator to generate an n-th emission control signal using the n-th gate signal. The signal generator may include a first 13 transistor to apply the n-th gate signal to a fifth control node based on a fourth clock signal, a second T3 transistor to output the first gate voltage as the n-th emission control signal based on a voltage of the fifth control node, and a third T3 transistor to output the second gate voltage as the n-th emission control signal based on the n-th gate signal. The third signal generator may include a fourth T3 transistor to apply the second gate voltage to the fifth control node based on the n-th gate signal.

The second clock signal may be delayed by one horizontal period from the first clock signal, the third clock signal may be delayed by one horizontal period from the second clock signal, the fourth clock signal may be delayed by one horizontal period from the third clock signal, and the first clock signal may be delayed by one horizontal period from the fourth clock signal.

The scan driver may include an (n−1)-th circuit stage, an n-th circuit stage, an (n+1)-th circuit stage, and an (n+2)-th circuit stage, the (n−1)-th circuit stage to generate an (n−1)-th gate signal synchronized with the first clock signal, the n-th circuit stage to generate an n-th gate signal synchronized with the second clock signal, the (n+1)-th circuit stage to generate an (n+1)-th gate signal synchronized with the third clock signal, and the (n+2)-th circuit stage to generate an (n+2)-th gate signal synchronized with the fourth clock signal. The scan driver may include plurality of NMOS transistors.

The pixel circuit may include an organic light-emitting diode; a driving transistor including a control electrode connected to a first node, a first electrode connected to a second node, and a second electrode receiving a first power voltage; a first pixel transistor including a control electrode receiving the n-th gate signal, a first electrode receiving a data voltage, and a second electrode connected to the first node; and a second pixel transistor including a control electrode receiving the n-th emission control signal, a first electrode to receive the first power voltage, and a second electrode connected to the driving transistor.

The pixel circuit may include a third pixel transistor including a control electrode to receive the n-th compensation control signal, a first electrode to receive a reference voltage, and a second electrode connected to the first node; and a fourth pixel transistor including a control electrode to receive an (n+1)-th gate signal, a first electrode to receive an initialization voltage, and a second electrode connected to the second node. The first, second, and driving transistors of the pixel circuit may be NMOS transistors.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
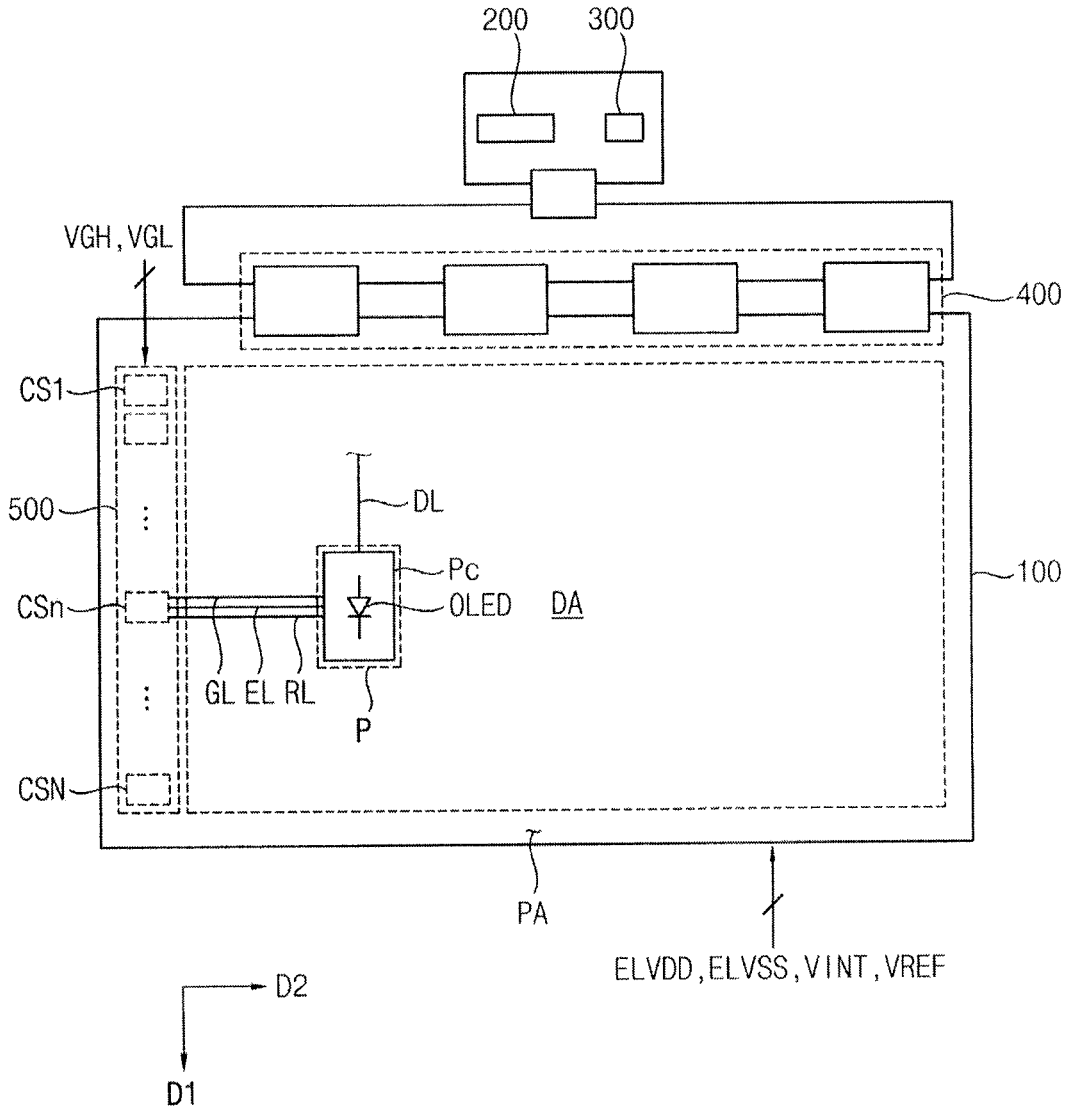
FIG. 1 illustrates an embodiment of a display apparatus.

Example embodiments will be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments, or certain aspects thereof, may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display apparatus which includes a display panel 100, a timing controller 200, a voltage generator 300, a data driver 400 and a scan driver 500. The display panel 100 includes a peripheral area PA surrounding a display area DA. Pixels P are arranged in a matrix in the display area DA. Each pixel P includes an organic light-emitting diode (OLED) and a pixel circuit including a plurality of pixel transistors to drive the OLED.

The display panel 100 includes a plurality of data lines DL, a plurality of gate lines GL, a plurality of emission control lines EL, and a plurality of compensation control lines RL to drive pixel circuits Pc. The data lines DL extends in a first direction D1 of the display panel 100 and apply data voltages to pixel columns. The gate lines GL, the emission control lines EL, and the compensation control lines RL extend in a second direction crossing the first direction D1 and respectively apply a gate signal, an emission control signal and a compensation control signal to a plurality of pixel rows.

The timing controller 200 controls general operations of the display apparatus. For example, the timing controller 200 generates a plurality of data control signals for controlling the data driver 400 and a plurality of scan control signals for controlling the scan driver 500. The scan control signals may include a plurality of scan start signals and a plurality of clock signals.

The voltage generator 300 generates a plurality of driving voltages, for example, based on an external voltage. The driving voltages may include a plurality of data driving voltages applied to the data driver 400, a plurality of scan driving voltages applied to the scan driver 500, and a plurality of panel driving voltages applied to the display panel 100. The scan driving voltages may include a first gate voltage VGH and a second gate voltage VGL. The panel driving voltages may include a first power voltage ELVDD, a second power voltage ELVSS, an initialization voltage VINIT, and a reference voltage VREF.

The data driver 400 may be mounted in the peripheral area PA of the display panel 100 and may output data voltages that are to be applied to pixel circuits Pc. The data driver 400 may output the data voltage by a horizontal period, for example, every pixel row.

The scan driver 500 may be directly integrated in the peripheral area PA of the display panel 100. The scan driver 500 may include, for example, a plurality of transistors, which, for example, may be formed by one or more processes used to form the pixel transistors in the pixel circuit Pc.

The scan driver 500 may include a plurality of circuit stages CS1, . . . , CSn, . . . , CSN to sequentially drive a plurality of pixel rows in the display area, where n and N are natural numbers. The scan driver 500 may generate a plurality of gate signals, a plurality of emission control signals, and a plurality of compensation control signals based on a plurality of clock signals from the timing controller 200. For example, an n-th circuit stage CSn of the scan driver 500 may generate and output an n-th gate signal, an n-th emission control signal, and an n-th compensation control signal for driving pixel circuits Pc in an n-th pixel row.

According to the exemplary embodiment, the scan driver 500 may generate the emission control signal and the compensation control signal based on the clock signals used for generating the gate signals. All or a portion of a gate driver for generating gate signals, and emission driver for generating emission control signals, and a compensation driver for generating compensation control signals may be directly integrated into the scan driver 500 in the peripheral area PA of the display panel 100. Thus, the size of the scan driver 500 may reduced.

Figure 2:
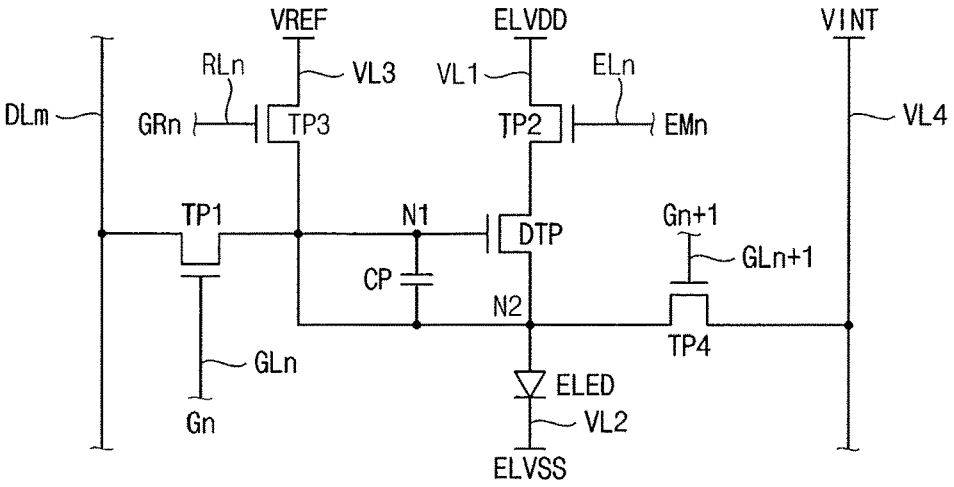
FIG. 2 illustrates an embodiment of a pixel circuit.
Figure 3:
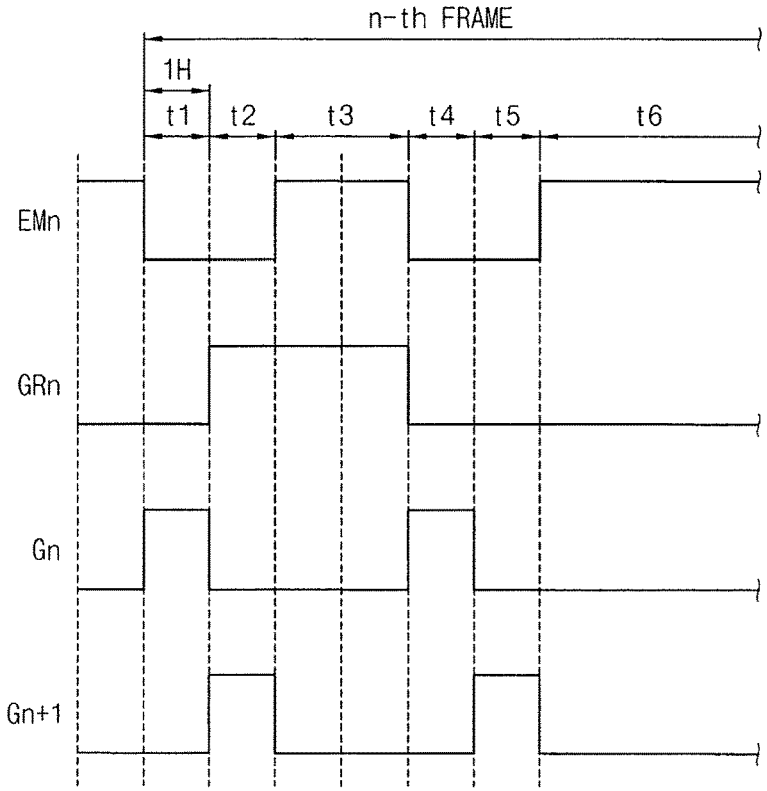
FIG. 3 illustrates an embodiment of driving signals for the pixel circuit.

FIG. 2 illustrates an embodiment of a pixel circuit Pc, and FIG. 3 illustrates an embodiment of driving signals for the pixel circuit Pc. Referring to FIGS. 2 and 3, the pixel circuit Pc may include an organic light-emitting diode OLED, a driving transistor DTp, a first pixel transistor Tp1, a second pixel transistor Tp2, a third pixel transistor Tp3, a fourth pixel transistor Tp4, and a pixel capacitor Cp. A plurality of transistors in the pixel circuit Pc may be NMOS (N-type Metal Oxide Semiconductor) transistors. An m-th data line DLm (m is a natural number), an n-th gate line GLn, an (n+1)-th gate line GLn+1, an n-th emission control line ELn, an n-th compensation control line RLn, a first power line VL1, a second power line VL2, a third power line VL3, and a fourth power line VL4 transfer driving signals to the pixel circuit Pc.

The driving transistor DTp includes a control electrode connected to a first node N1, a first electrode connected to a second pixel transistor Tp2, and a second electrode connected to a second node N2. The second node N2 is connected to an anode electrode of the organic light-emitting diode OLED. A cathode electrode of the organic light-emitting diode OLED is connected to the second power line VL2. The second power line VL2 applies the second power voltage ELVSS.

The first pixel transistor Tp1 includes a control electrode connected to an n-th gate line GLn, a first electrode connected to the m-th data line DLm, and a second electrode connected to the first node N1.

The second pixel transistor Tp2 includes a control electrode connected to the n-th emission control line ELn, a first electrode connected to the first power line VL1, and a second electrode connected to the driving transistor DTp. The first power line VL1 transfers a first power voltage ELVDD. The n-th emission control line ELn transfers an n-th emission control signal EMn.

The third pixel transistor Tp3 includes a control electrode connected to the n-th compensation control line RLn, a first electrode connected to the third power line VL3, and a second electrode connected to the first node N1. The third power line VL3 transfers a reference voltage VREF. The n-th compensation control line RLn transfers an n-th compensation control signal GRn.

The fourth pixel transistor Tp4 includes a control electrode connected to the (n+1)-th gate line GLn+1, a first electrode connected to the fourth power line VL4, and a second electrode connected to the second node N2. The fourth power line VL4 transfers an initialization voltage VINT.

The pixel capacitor Cp includes a first electrode connected to the first node N1 and a second electrode connected to the second node N2.

In operation, during a first period t1, the first pixel transistor Tp1 is turned on based on a high voltage of the n-th gate signal Gn. The second, third, and fourth transistors Tp2, Tp3, and Tp4 are turned off based on low voltages of an n-th emission control signal EMn, an n-th compensation control signal GRn, and an (n+1)-th gate signal Gn+1, respectively. Therefore, the organic light-emitting diode OLED does not emit a light. The first period t1 may correspond to an emission off period.

During a second period t2, the third pixel transistor Tp3 and the fourth pixel transistor Tp4 are turned on based on high voltages of the n-th compensation control signal GRn and the (n+1)-th gate signal Gn+1, respectively, and the first and second pixel transistors Tp1 and Tp2 are turned off. Thus, the reference voltage VREF is applied to the first node N1, and the initialization voltage VINT is applied to the second node N2. The second period t2 may correspond to an initialization period of the driving transistor DTp.

During a third period t3, the second and third pixel transistors Tp2 and Tp3 are turned on based on high voltages of the n-th emission control signal EMn, and the n-th compensation control signal GRn, respectively, and the first and fourth pixel transistors Tp1 and Tp4 are turned off. Therefore, the reference voltage VREF applied to the first electrode of the driving transistor DTp is discharged to a difference voltage VREF-Vth between the reference voltage and a threshold voltage of the driving transistor DTp and the pixel capacitor Cp may store the threshold voltage. Also, during the third period t3, the voltage applied to the first electrode the driving transistor DTp may be maintained. The third period t3 may correspond to a compensation period of driving transistor DTp.

During a fourth period t4, the first pixel transistor Tp1 is turned on based on the high voltage of the n-th gate signal Gn and the second, third and fourth pixel transistors Tp2, Tp3 and Tp4 are turned off Thus, the first node N1 receives a data voltage through the m-th data line DLm. The data voltage may correspond to a grayscale data of a pixel and the luminance of light emitted from the organic light-emitting diode OLED. During the fourth period t4, the pixel capacitor Cp may store the data voltage. The fourth period t4 may correspond to a data writing period.

During a fifth period t5, the fourth pixel transistor Tp4 is turned on based on the high voltage of the gate signal Gn+1 and the first, second and third pixel transistors Tp1, Tp2 and Tp3 are turned off Thus, the initialization voltage VNIT is applied to the second node N2 and the anode electrode of the organic light-emitting diode OLED may be initialized. The fifth period t5 may correspond to an initialization period of the organic light-emitting diode OLED.

During a sixth period t6, the second pixel transistor Tp2 is turned on based on the high voltage of the n-th emission control signal EMn and the first, third, and fourth pixel transistors Tp1, Tp3, and Tp4 are turned off. Thus, the driving transistor DTp drives the organic light-emitting diode OLED based on the voltage charged in the pixel capacitor Cp and the organic light-emitting diode OLED emits light. The sixth period t6 may correspond to an emission period of the organic light-emitting diode OLED.

As described above, the pixel circuit Pc may be driven by the n-th and (n+1)-th gate signals Gn and Gn+1, the n-th emission control signal EMn, and the n-th compensation control signal GRn.

Figure 4:
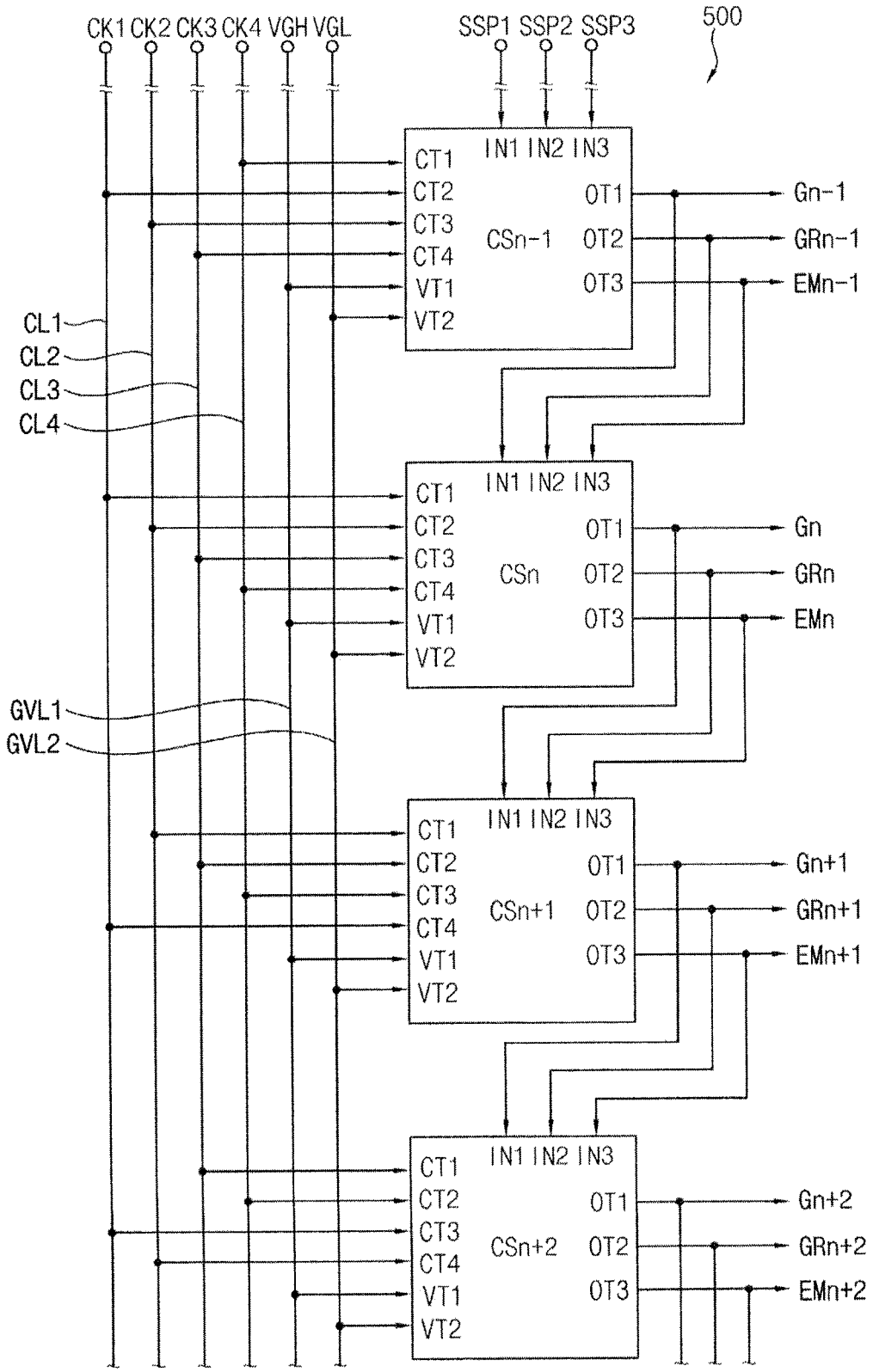
FIG. 4 illustrates an embodiment of a scan driver.

FIG. 4 illustrates an embodiment of a scan driver 500 may include a plurality of circuit stages CSn−1, CSn, CSn+1, and CSn+2. The scan driver 500 may further include first, second, third, and fourth clock lines CL1, CL2, CL3, and CL4 which transfer first, second, third, and fourth clock signals CK1, CK2, CK3 and CK4, respectively, a first gate voltage line GVL1 which applies a first gate voltage VGH, and a second gate voltage line GVL2 which applies a second gate voltage VGL.

When a first circuit stage CS1 of the scan driver 500 receives a first scan start signal SSP1, a second scan start signal SSP2, and a third scan start signal SSP3 from a timing controller, the scan driver 500 may sequentially output a plurality of gate signals Gn−1, Gn, Gn+1, and Gn+2 based on the first scan start signal SSP1, may sequentially output a plurality of compensation control signals GRn−1, GRn, GRn+1, and GRn+2 based on the second scan start signal SSP2, and may sequentially output a plurality of emission control signals EMn−1, EMn, EMn+1, and EMn+2 based on the third scan start signal SSP3.

Each of the circuit stages CSn−1, CSn, CSn+1, and CSn+2 may include first to third input terminals IN1, IN2, and IN3, first to fourth clock terminals CT1, CT2, CT3, and CT4, first to third output terminals OT1, OT2, and OT3 and first and second voltage terminals VT1 and VT2.

The first input terminal IN1 receives a previous gate signal. A second input terminal IN2 receives a previous emission control signal. An third input terminal IN3 receives a previous compensation control signal.

The first to fourth clock terminals CT1, CT2, CT3, and CT4 receives first to fourth clock signals CK1, CK2, CK3, and CK4. For example, referring to FIG. 3, a first clock signal CK1 has a high voltage during a first period t1 corresponding to an emission off period and a fourth period t4 corresponding to a data writing period, and a low voltage during a remaining period of a frame period. A second clock signal CK2 may be delayed by one horizontal period from the first clock signal CK1. A third clock signal CK3 may be delayed by one horizontal period from the second clock signal CK2. A fourth clock signal CK4 may be delayed by one horizontal period from the third clock signal CK3. The first clock signal CK1 may be delayed by one horizontal period from the fourth clock signal CK4.

A first voltage terminal VT1 receives a first gate voltage VGH and a second voltage terminal VT2 receives a second gate voltage VGL.

A first output terminal OT1 outputs a gate signal, a second output terminal OT2 outputs a compensation control signal, and a third output terminal OT3 output an emission control signal. For example, referring to the n-th circuit stage CSn, the first input terminal IN1 receives an (n−1)-th gate signal Gn−1, the second input terminal IN2 receives an (n−1)-th emission control signal EMn−1, and the third input terminal IN3 receives an (n−1)-th compensation control signal GRn−1. The (n−1)-th gate signal Gn−1 may be synchronized with the first clock signal CK1.

A first clock terminal CT1 receives the first clock signal CK1. A second clock terminal CT2 receives the second clock signal CK2. A third clock terminal CT3 receives third clock signal CK3. A fourth clock terminal CT4 receives fourth clock signal CK4.

A first output terminal OT1 outputs an n-th gate signal Gn synchronized with the second clock signal CK2. A second output terminal OT2 outputs an n-th compensation control signal GRn. A third output terminal OT3 outputs an n-th emission control signal EMn.

However, referring to an (n+1)-th circuit stage CSn+1, a first input terminal IN1 receives an n-th gate signal Gn, a second input terminal IN2 receives an n-th emission control signal EMn, and a third input terminal IN3 receives an n-th compensation control signal GRn.

The first to fourth clock terminals CT1, CT2, CT3, and CT4 receives the first to fourth clock signals CK1, CK2, CK3, and CK4 delayed by one horizontal period with respect to the n-th circuit stage CSn. For example, the first clock terminal CT1 receives the second clock signal CK2. The second clock terminal CT2 receives the third clock signal CK3. The third clock terminal CT3 receives the fourth clock signal CK4. The fourth clock terminal CT4 receives the first clock signal CK1.

A first output terminal OT1 outputs an (n+1)-th gate signal Gn+1 synchronized with the third clock signal CK3. A second output terminal OT2 outputs an (n+1)-th compensation control signal GRn+1. A third output terminal OT3 outputs an (n+1)-th emission control signal EMn+1.

However, referring to an (n+2)-th circuit stage CSn+2, a first input terminal IN1 receives the (n+1)-th gate signal Gn+1, a second input terminal IN2 receives the (n+1)-th emission control signal EMn+1 and a third input terminal IN3 receives the (n+1)-th compensation control signal GRn+1.

The first to fourth clock terminals CT1, CT2, CT3, and CT4 receives the first to fourth clock signals CK1, CK2, CK3, and CK4 delayed by one horizontal period with respect to the (n+1)-th circuit stage CSn+1. For example, the first clock terminal CT1 receives the third clock signal CK3. The second clock terminal CT2 receives the fourth clock signal CK4. The third clock terminal CT3 receives the first clock signal CK1. The fourth clock terminal CT4 receives the second clock signal CK2.

A first output terminal OT1 outputs an (n+2)-th gate signal Gn+2 synchronized with the fourth clock signal CK4. A second output terminal OT2 outputs an (n+2)-th compensation control signal GRn+2. A third output terminal OT3 outputs an (n+2)-th emission control signal EMn+2.

As described above, each of the circuit stages CSn−1, CSn, CSn+1, and CSn+2 may generate the emission control signal and the compensation control signal based on the clock signals used to generate the gate signals.

Figure 5:
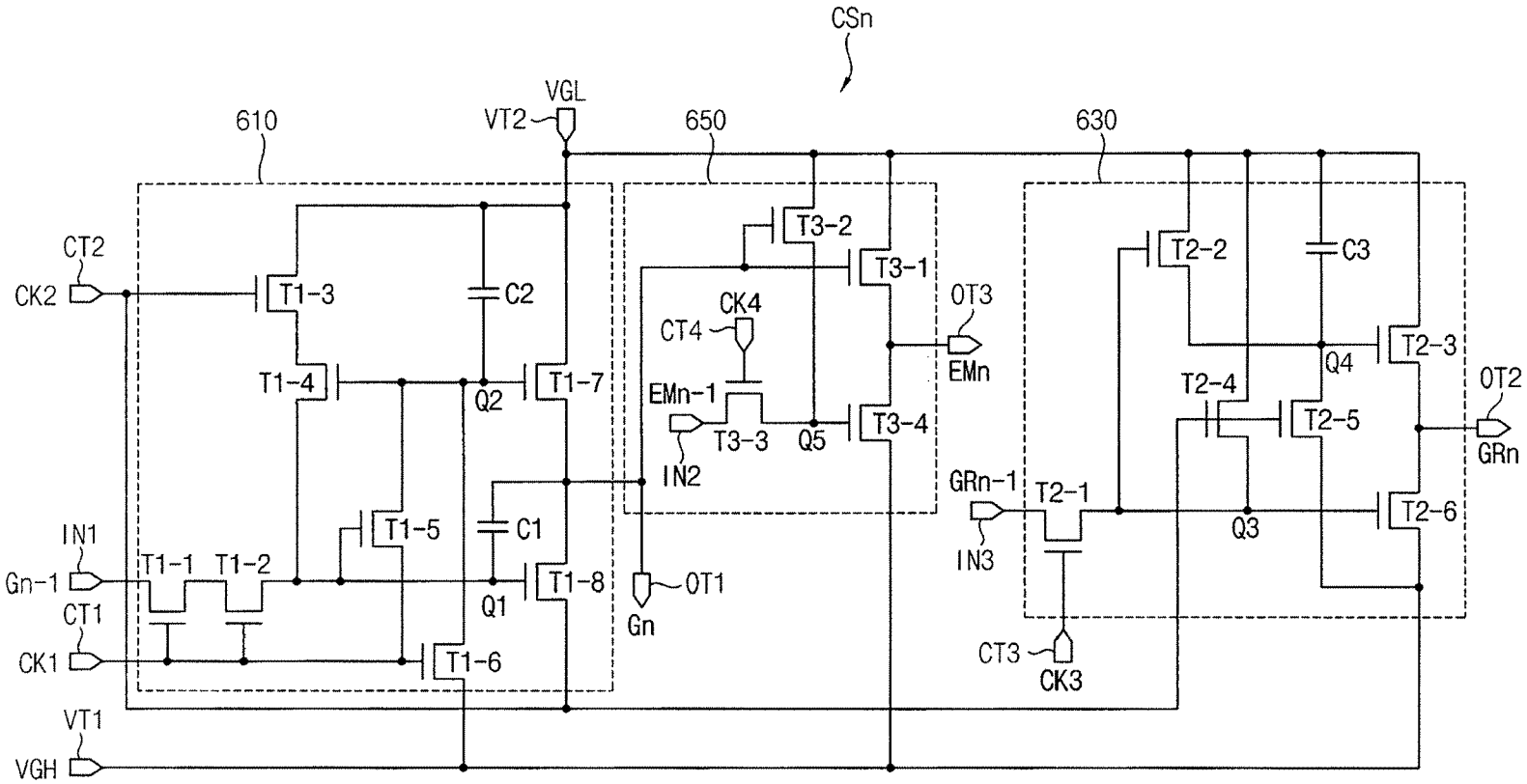
FIG. 5 illustrates an embodiment of an n-th circuit stage of a scan driver.

FIG. 5 illustrates an embodiment of an n-th circuit stage of a scan driver which may include a first signal generator 610, a third signal generator 650, and a second signal generator 630 which include a plurality of transistors, respectively. The transistors may be, for example, NMOS (N-type Metal Oxide Semiconductor) transistors. In another embodiment, the transistors may be p-type MOS transistors.

The n-th circuit stage CSn includes a first clock terminal CT1 receiving a first clock signal CK1, a second clock terminal CT2 receiving a second clock signal CK2, a third clock terminal CT3 receiving a third clock signal CK3, a fourth clock terminal CT4 receiving a fourth clock signal CK4, a first voltage terminal VT1 receiving a first gate voltage VGH and a second voltage terminal VT2 receiving a second gate voltage VGL. In addition, the n-th circuit stage CSn includes a first input terminal IN1 receiving an (n−1)-th gate signal Gn−1, a second input terminal IN2 receiving an (n−1)-th emission control signal EMn−1, and a third input terminal IN3 receiving an (n−1)-th compensation control signal GRn−1. In addition, the n-th circuit stage CSn includes a first output terminal OT1 outputting an n-th gate signal Gn, an second output terminal OT2 outputting an n-th compensation control signal GRn and a third output terminal OT3 outputting an n-th emission control signal EMn.

The first signal generator 610 may generate the n-th gate signal Gn using the (n−1)-th gate signal Gn−1, the first clock signal CK1, and the second clock signal CK2. The first signal generator 610 include a (1-1)-th transistor T1-1, a (1-2)-th transistor T1-2, a (1-3)-th transistor T1-3, a (1-4)-th transistor T1-4, a (1-5)-th transistor T1-5, a (1-6)-th transistor T1-6, a (1-7)-th transistor T1-7 and a (1-8)-th transistor T1-8.

The (1-1)-th transistor T1-1 includes a control electrode connected to the first clock terminal CT1, a first electrode connected to the first input terminal IN1, and a second electrode connected to the (1-2)-th transistor T1-2.

The (1-2)-th transistor T1-21 includes a control electrode connected to the first clock terminal CT1, a first electrode connected to the (1-1)-th transistor T1-1, and a second electrode connected to a first control node Q1.

The (1-3)-th transistor T1-3 includes a control electrode connected to second clock terminal CT2, a first electrode connected to second voltage terminal VT2, and a second electrode connected to the (1-4)-th transistor T1-4.

The (1-4)-th transistor T1-4 includes a control electrode connected to second control node Q2, a first electrode connected to the (1-3)-th transistor T1-3, and a second electrode connected to the first control node Q1.

The (1-5)-th transistor T1-5 includes a control electrode connected to the first control node Q1, a first electrode connected to the second control node Q2, and a second electrode connected to the first clock terminal CT1.

The (1-6)-th transistor T1-6 includes a control electrode connected to the first clock terminal CT1, a first electrode connected to the second control node Q2, and a second electrode connected to the first voltage terminal VT1.

The (1-7)-th transistor T1-7 includes a control electrode connected to the second control node Q2, a first electrode connected to the second voltage terminal VT2, and a second electrode connected to the first output terminal OT1.

The (1-8)-th transistor T1-8 includes a control electrode connected to the first control node Q1, a first electrode connected to the second clock terminal CT2, and a second electrode connected to the first output terminal OT1.

In addition, the first signal generator 610 includes a first capacitor C1 connected to the first control node Q1 and a second capacitor C2 connected to the second control node Q2.

The third signal generator 650 may generate an n-th emission control signal EMn based on the n-th gate signal Gn and fourth clock signal CK4. The third signal generator 650 includes a (3-1)-th transistor T3-1, a (3-2)-th transistor T3-2, a (3-3)-th transistor T3-3 and a (3-4)-th transistor T3-4.

The (3-1)-th transistor T3-1 includes a control electrode connected to the first output terminal OT1, a first electrode connected to the second voltage terminal VT2, and a second electrode connected to the third output terminal OT3.

The (3-2)-th transistor T3-2 includes a control electrode connected to the first output terminal OT1, a first electrode connected to the second voltage terminal VT2, and a second electrode connected to a fifth control node Q5.

The (3-3)-th transistor T3-3 includes a control electrode connected to the fourth clock terminal CT4, a first electrode connected to the second input terminal IN2, and a second electrode connected to the fifth control node Q5.

The (3-4)-th transistor T3-4 includes a control electrode connected to the fifth control node Q5, a first electrode connected to the first voltage terminal VT1, and a second electrode connected to the third output terminal OT3.

The second signal generator 630 may generate an n-th compensation control signal GRn based on an (n−1)-th compensation control signal GRn−1 of an (n−1)-th circuit stage CSn−1, the second clock signal CK2, and the third clock signal CK3. The second signal generator 630 includes a (2-1)-th transistor T2-1, a (2-2)-th transistor T2-2, a (2-3)-th transistor T2-3, a (2-4)-th transistor T2-4, a (2-5)-th transistor T2-5, and a (2-6)-th transistor T2-6.

The (2-1)-th transistor T2-1 includes a control electrode connected to the third clock terminal CT3, a first electrode connected to the third input terminal IN3, and a second electrode connected to a third control node Q3.

The (2-2)-th transistor T2-2 includes a control electrode connected to the third control node Q3, a first electrode connected to the second voltage terminal VT2, and a second electrode connected to a fourth control node Q4.

The (2-3)-th transistor T2-3 includes a control electrode connected to the fourth control node Q4, a first electrode connected to the second voltage terminal VT2, and a second electrode connected to the second output terminal OT2.

The (2-4)-th transistor T2-4 includes a control electrode connected to the second clock terminal CT2, a first electrode connected to the second voltage terminal VT2, and a second electrode connected to the third control node Q3.

The (2-5)-th transistor T2-5 includes a control electrode connected to the second clock terminal CT2, a first electrode connected to the second voltage terminal VT2, and a second electrode connected to the fourth control node Q4.

The (2-6)-th transistor T2-6 includes a control electrode connected to the third control node Q3, a first electrode connected to the first voltage terminal VT1, and a second electrode connected to the second output terminal OT2.

The second signal generator 630 may include a third capacitor C3 connected to the fourth control node Q4.

Figure 6:
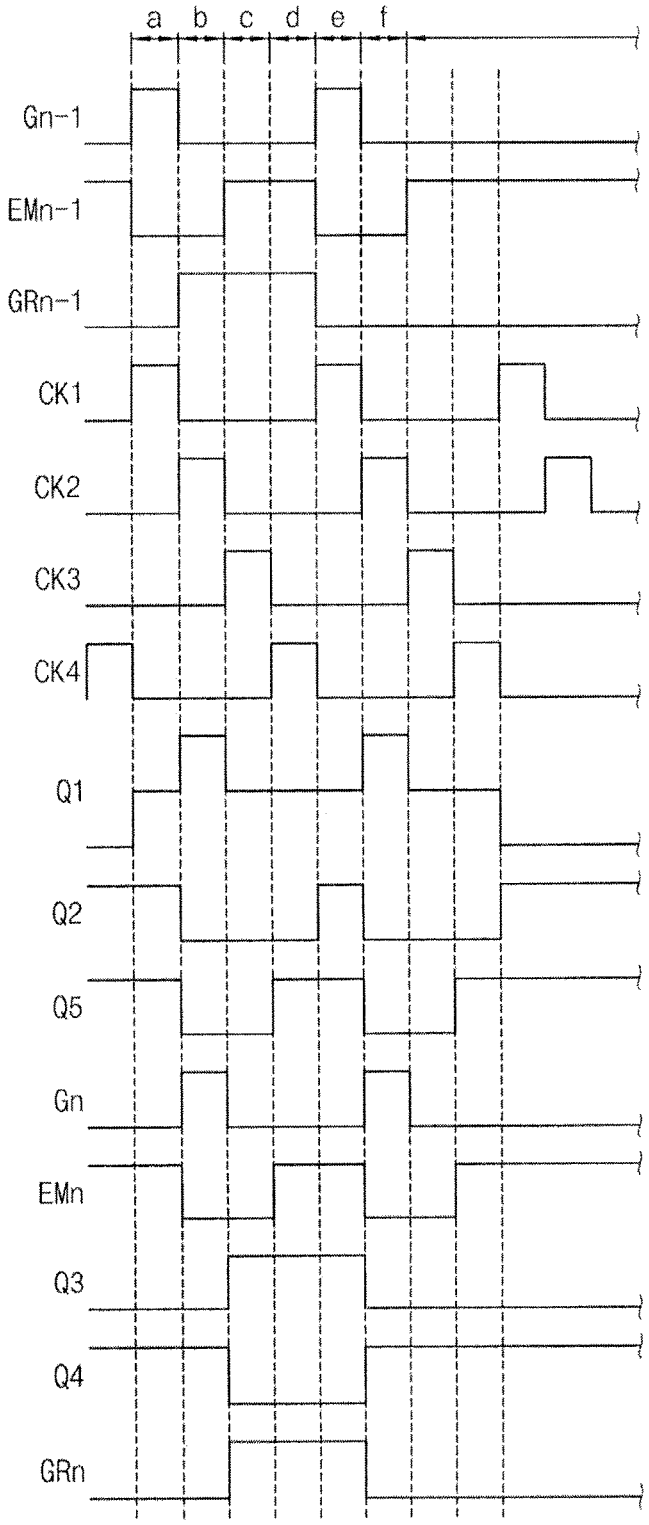
FIG. 6 illustrates an embodiment of a method for driving an n-th circuit stage.

FIG. 6 illustrates an embodiment of a method for driving an n-th circuit stage. Referring to FIGS. 5 and 6, the method drives an n-th circuit stage in a first period a, a second period b, a third period c, a fourth period d, a fifth period e, and a sixth period f of a frame period as described.

During the first period a, the first signal generator 610 may output the low voltage of the n-th gate signal Gn. For example, the (1-1)-th, (1-2)-th and (1-6)-th transistors T1-1, T1-2 and T1-6 are turned on based on the high voltage of the first clock signal CK1. Thus, the (1-5)-th transistor T1-5 is turned on. The (1-5)-th transistor T1-5 is turned on, and thus the high voltage of the first clock signal CK1 is applied to the second control node Q2. The (1-6)-th transistor T1-6 is turned on, and thus the first gate voltage VGH is applied to the second control node Q2. The (1-1)-th and (1-2)-th transistor T1-1 are turned on, and thus the high voltage of the (n−1)-th gate signal Gn−1 is applied to the first control node Q1. The (1-8)-th transistor T1-8 is turned on by the high voltage of the first control node Q1 and the low voltage of second clock signal CK2 is output through the first output terminal OT1. The (1-7)-th transistor T1-7 is turned on by the high voltage of the second control node Q2, and the low voltage of the n-th gate signal Gn that is the second gate voltage VGL is output through the first output terminal OT1.

During the first period a, the third signal generator 650 may output the high voltage of the n-th emission control signal EMn. For example, the (3-1)-th and (3-2)-th transistors T3-1 and T3-2 are turned off based on the low voltage of the n-th gate signal Gn. The (3-3)-th transistor T3-3 is turned off based on the low voltage of the fourth clock signal CK4. Thus, the fifth control node Q5 is maintained at the high voltage applied in a previous frame period. The (3-4)-th transistor T3-4 is turned on based on the high voltage of the fifth control node Q5 and the third output terminal OT3 outputs the first gate voltage VGH. Therefore, the third output terminal OT3 may output the high voltage of the n-th emission control signal.

During the first period a, the second signal generator 630 may output the low voltage of the n-th compensation control signal GRn. For example, in the first period a, the second clock signal CK2, the third clock signal CK3, and the (n−1)-th compensation control signal GRn−1 all have low voltage. Thus, the (2-1)-th to (2-6)-th transistors T2-1, T2-2, T2-3, T2-4, T2-5, and T2-6 are turned off and the second output terminal OT2 is maintained at the low voltage applied in the previous frame period. Thus, second output terminal OT2 may output the low voltage of the n-th compensation control signal GRn.

During a second period b, the first signal generator 610 may output the high voltage of the n-th gate signal Gn. For example, (1-1)-th, (1-2)-th and (1-6)-th transistors T1-1, T1-2 and T1-6 are turned off the based on the low voltage of the first clock signal CK1. The (1-5)-th transistor T1-5 is turned on by a charging voltage in a first capacitor C1 connected to the first control node Q1. A voltage of the first control node Q1 is boosted up. The (1-8)-th transistor T1-8 is turned on based on the boosted voltage of the first control node Q1, and the first output terminal OT1 may output the high voltage of the second clock signal CK2. The first output terminal OT1 may output the high voltage of the second clock signal CK2 as the high voltage of the n-th gate signal Gn.

During the second period b, the third signal generator 650 may output the low voltage of the n-th emission control signal EMn. For example, the (3-1)-th and (3-2)-th transistors T3-1 and T3-2 are turned based on the high voltage of the n-th gate signal Gn. The (3-2)-th transistor T3-2 is turned on, and thus the second gate voltage VGL is applied to the fifth control node Q5. The (3-4)-th transistor T3-4 is turned off based on the low voltage of the fifth control node Q5, the (3-1)-th transistor T3-1 is turned on, and the second gate voltage VGL is applied to the third output terminal OT3. Thus, the third output terminal OT3 may output the low voltage of n-th emission control signal EMn.

During the second period b, the second signal generator 630 may output the low voltage of the n-th compensation control signal GRn. For example, in the second period b, the second clock signal CK2 and the (n−1)-th compensation control signal GRn−1 have the high voltage and the third clock signal CK3 has the low voltage. The (2-4)-th transistor T2-4 is turned on, and the second gate voltage VGL is applied to the third control node Q3. The (2-6)-th transistor T2-6 is turned off based on the low voltage of the third control node Q3. The (2-5)-th transistor T2-5 is turned on and the first gate voltage VGH is applied to the fourth control node Q4. The (2-3)-th transistor T2-3 is turned on based on the high voltage of the fourth control node Q4. Thus, the second output terminal OT2 may output the second gate voltage VGL as the low voltage of the n-th compensation control signal GRn.

During a third period c, the first signal generator 610 may output the low voltage of the n-th gate signal Gn. For example, the first signal generator 610 may receive the low voltage of the first clock signal CK1, the low voltage of the second clock signal CK2, and the low voltage of the (n−1)-th gate signal Gn−1. Thus, the (1-1)-th, (1-2)-th, (1-3)-th, and (1-6)-th transistors T1-1, T1-2, T1-3, and T1-6 are turned off. The (1-5)-th and (1-8)-th transistors are turned on based on the high voltage of the first control node Q1. Thus, the low voltage of the first clock signal CK1 is applied to the second control node Q2 and the first output terminal OT1 outputs the low voltage of the second clock signal. The first output terminal OT1 may output the low voltage of the second clock signal CK2 as the low voltage of the n-th gate signal Gn.

During the third period c, the third signal generator 650 may output the low voltage of the n-th emission control signal EMn. For example, the third signal generator 650 may receive the low voltage of the n-th gate signal Gn and the low voltage of the fourth clock signal CK4. Thus, the (3-1)-th to (3-4)-th transistors T3-1 to T3-4 are turned off. The third output terminal OT3 is maintained at the low voltage of the n-th emission control signal EMn applied in the second period b.

During the third period c, the second signal generator 630 may output the high voltage of the n-th compensation control signal GRn. For example, the second signal generator 630 may receive the low voltage of the second clock signal CK2, the high voltage of the third clock signal CK3, and the high voltage of the (n−1)-th compensation control signal GRn−1.

The (2-1)-th transistor T2-1 is turned on based on the high voltage of the third clock signal CK3, and the high voltage of the (n−1)-th compensation control signal GRn−1 is applied to the third control node Q3.

The (2-2)-th transistor T2-2 is turned on by the (2-1)-th transistor T2-1 being turned on and the second gate voltage VGL is applied to the fourth control node Q4. The (2-3)-th transistor T2-3 is turned off based on the low voltage of the fourth control node Q4.

The (2-6)-th transistor T2-6 applies the first gate voltage VGH to the second output terminal OT2 based on the high voltage of the third control node Q3. Thus, the second output terminal OT2 may output the high voltage of the n-th compensation control signal GRn.

During the fourth period d, the first signal generator 610 may output the low voltage of the n-th gate signal Gn. For example, the first signal generator 610 may receive the low voltage of the first clock signal CK1, the low voltage of the second clock signal CK2, and the low voltage of the (n−1)-th gate signal Gn−1. Thus, the (1-1)-th, (1-2)-th, (1-3)-th, and (1-6)-th transistors T1-1, T1-2, T1-3, and T1-6 are turned off. However, the (1-5)-th and (1-8)-th transistors are turned on based on the high voltage of the first control node Q1. The (1-5)-th transistor T1-5 applies the low voltage of the first clock signal CK1 to the second control node Q2. The (1-8)-th transistor T1-8 applies the low voltage of the second clock signal to the first output terminal OT1. The first output terminal OT1 may output the low voltage of the second clock signal CK2 as the low voltage of the n-th gate signal Gn.

During the fourth period d, the third signal generator 650 may output the high voltage of the n-th emission control signal EMn. For example, the third signal generator 650 may receive the low voltage of the n-th gate signal Gn, the high voltage of the fourth clock signal CK4, and the high voltage of the (n−1)-th emission control signal EMn−1. Thus, the (3-1)-th and (3-2)-th transistors T3-1 and T3-2 are turned off based on the low voltage of the gate signal Gn, and the (3-3)-th transistor T3-3 is turned on. The (3-3)-th transistor T3-3 is turned on based on the high voltage of the fourth clock signal ck4 and applies the high voltage of the (n−1)-th emission control signal EMn−1 to the fifth control node Q5. The (3-4)-th transistor T3-4 is turned on based on the high voltage of the fifth control node Q5 and applies the first gate voltage VGH to the third output terminal OT3. The third output terminal OT3 may output the high voltage of the n-th emission control signal EMn.

During the fourth period d, the second signal generator 630 may output the high voltage of the n-th compensation control signal GRn. For example, the second signal generator 630 may receive the low voltage of the second clock signal CK2, the low voltage of the third clock signal CK3, and the high voltage of the (n−1)-th compensation control signal GRn−1. The (2-1)-th transistor T2-1 is turned off based on the low voltage of the third clock signal CK3, and the (2-4)-th and (2-5)-th transistors 12-4 and T2-5 are turned off based on the low voltage of the second clock signal CK2. The third control node Q3 is maintained at the high voltage applied in the previous frame period. The (2-6)-th transistor T2-6 is turned on based on the high voltage of the third control node Q3 and applies the first gate voltage VGH to the second output terminal OT2. Second output terminal OT2 may output the high voltage of n-th compensation control signal GRn.

During a fifth period e, operations of the first and third signal generators 610 and 650 may be substantially same as those of the first and third signal generators 610 and 650 in the first period a. Thus, the first output terminal OT1 of the first signal generator 610 may output the low voltage of the n-th gate signal Gn, and the third output terminal OT3 of the third signal generator 650 may output the high voltage of the n-th emission control signal EMn.

However, operations of the second signal generator 630 may be substantially same as those of the second signal generator 630 in the fourth period d. Thus, the second output terminal OT2 of the second signal generator 630 may output the high voltage of the n-th compensation control signal GRn.

During a sixth period f, operations of first, second, and third signal generators 610, 630, and 650 may be substantially same as those of the first, second and second signal generators 610, 630, and 650 in the second period b. Thus, the first output terminal OT of the first signal generator 610 may output the high voltage of the n-th gate signal Gn. The second output terminal OT2 of the second signal generator 630 may output the low voltage of the n-th compensation control signal GRn. The third output terminal OT3 of the third signal generator 650 may output the low voltage of the n-th emission control signal EMn.

As described above, the n-th circuit stage CSn may generate the n-th gate signal Gn, the n-th emission control signal EMn, and the n-th compensation control signal GRn based on the first to fourth clock signals CK1, CK2, CK3, and CK4.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, generators, and other processing features of the embodiments disclosed herein may be implemented in logic which, for example, may include hardware, software, or both. When implemented at least partially in hardware, the controllers, generators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, generators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, the size of the scan driver (which is integrated in a peripheral area of the display panel) may be decreased. In addition, an outer driving circuit of the display apparatus may be decreased. Thus, manufacturing costs may be decreased.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A scan driver, comprising:

a plurality of circuit stages sequentially outputting a plurality of gate signals and a plurality of compensation control signals, a single n-th circuit stage of the plurality of circuit stages comprising:

a first signal generator includes:

a first T1 transistor to apply an (n−1)-th gate signal to a first control node based on a first clock signal, a second T1 transistor to output an n-th gate signal synchronized with a second clock signal different from the first clock signal based on a voltage of the first control node, a third T1 transistor to apply a first gate voltage to a second control node based on the first clock signal, and a fourth T1 transistor to output a second gate voltage as the n-th gate signal based on a voltage of the second control node (n is a natural number); and a second signal generator including:

a first T2 transistor to apply an (n−1)-th compensation control signal to a third control node based on a third clock signal different from the first and second clock signals, a second T2 transistor to output the first gate voltage as an n-th compensation control signal based on a voltage of the third control node, a third T2 transistor to apply the first gate voltage to a fourth control node based on the second clock signal, and a fourth T2 transistor to output the second gate voltage as the n-th compensation control signal based on a voltage of the fourth control node, wherein an activated state of the (n−1)-th compensation control signal, an activated state of the n-th compensation control signal, and an activated state of the third clock signal overlap each other.

2. The scan driver as claimed in claim 1, wherein the second signal generator includes:

a fifth T2 transistor to apply the second gate voltage to the third control node based on the second clock signal; and a sixth T2 transistor to apply the second gate voltage to the fourth control node based on the (n−1)-th compensation control signal.

3. The scan driver as claimed in claim 1, wherein the first signal generator includes:

a fifth T1 transistor to apply the first clock signal to the second control node based on a voltage of the first control node;

a sixth T1 transistor to be driven based on the second clock signal;

a seventh T1 transistor to be driven based on a voltage of the second control node; and an eighth T1 transistor to be driven based on the first clock signal.

4. The scan driver as claimed in claim 1, wherein the n-th circuit stage further comprises:

a third signal generator to generate an n-th emission control signal based on the n-th gate signal.

5. The scan driver as claimed in claim 4, wherein the third signal generator includes:

a first T3 transistor to apply the n-th gate signal to a fifth control node based on a fourth clock signal different from the first, second and third clock signals, a second T3 transistor to output the first gate voltage as the n-th emission control signal based on a voltage of the fifth control node, and a third T3 transistor to output the second gate voltage as the n-th emission control signal based on the n-th gate signal.

6. The scan driver as claimed in claim 5, wherein the third signal generator includes a fourth T3 transistor to apply the second gate voltage to the fifth control node based on the n-th gate signal.

7. The scan driver as claimed in claim 5, wherein:

the second clock signal is to be delayed by one horizontal period from the first clock signal, the third clock signal is to be delayed by one horizontal period from the second clock signal, the fourth clock signal is to be delayed by one horizontal period from the third clock signal, and the first clock signal is to be delayed by one horizontal period from the fourth clock signal.

8. The scan driver as claimed in claim 7, wherein:

an (n−1)-th circuit stage is to generate an (n−1)-th gate signal synchronized with the first clock signal, an n-th circuit stage is to generate an n-th gate signal synchronized with the second clock signal, an (n+1)-th circuit stage is to generate an (n+1)-th gate signal synchronized with the third clock signal, and an (n+2)-th circuit stage is to generate an (n+2)-th gate signal synchronized with the fourth clock signal.

9. A display apparatus, comprising:

a display panel including a plurality of pixel circuits on a display area; and a scan driver on a peripheral area surrounding the display area, the scan driver including a plurality of circuit stages to output plurality of gate signals, a plurality of emission control signals, and a plurality of compensation control signals, wherein a single n-th circuit stage of the plurality of circuit stages includes a first signal generator which includes:

a first T1 transistor to apply an (n−1)-th gate signal to a first control node based on a first, clock signal, a second T1 transistor to output an n-th gate signal synchronized with a second clock signal different from the first clock signal based on a voltage of the first control node, a third T1 transistor to apply a first gate voltage to a second control node based on the first clock signal, and a fourth T1 transistor to output a second gate voltage as the n-th gate signal based on a voltage of the second control node (n is a natural number), and a second signal generator which includes:

a first T2 transistor to apply an (n−1)-th compensation control signal to a third control node based on a third clock signal different from the first and second clock signals, a second T2 transistor to output the first gate voltage as an n-th compensation control signal based on a voltage of the third control node, a third T2 transistor to apply the first gate voltage to a fourth control node based on the second clock signal, and a fourth T2 transistor to output the second gate voltage as the n-th compensation control signal based on a voltage of the fourth control node, wherein an activated state of the (n−1)-th compensation control signal, an activated state of the n-th compensation control signal, and an activated state of the third clock signal overlap each other.

10. The display apparatus as claimed in claim 9, wherein the second signal generator includes:

a fifth T2 transistor to apply the second gate voltage to the third control node based on the second clock signal; and a sixth T2 transistor to apply the second gate voltage to the fourth control node based on the (n−1)-th compensation control signal.

11. The display apparatus as claimed in claim 9, wherein the first signal generator includes:

a fifth T1 transistor to apply the first clock signal to the second control node based on a voltage of the first control node;

a sixth T1 transistor to be driven based on the second clock signal;

a seventh T1 transistor to be driven based on a voltage of the second control node; and a eighth T1 transistor to be driven based on the first clock signal.

12. The display apparatus as claimed in claim 9, wherein the first, second, third, and fourth T1 transistors and first, second, third, and fourth T2 transistors are NMOS transistors.

13. The display apparatus as claimed in claim 9, wherein each of the plurality of pixel circuits includes:

an organic light-emitting diode;

a driving transistor including a control electrode connected to a first node, a first electrode connected to a second node, and a second electrode receiving a first power voltage;

a first pixel transistor including a control electrode receiving the n-th gate signal, a first electrode receiving a data voltage, and a second electrode connected to the first node; and a second pixel transistor including a control electrode receiving the n-th emission control signal, a first electrode to receive the first power voltage, and a second electrode connected to the driving transistor.

14. The display apparatus as claimed in claim 13, wherein each of the plurality of pixel circuits further includes:

a third pixel transistor including a control electrode to receive the n-th compensation control signal, a first electrode to receive a reference voltage, and a second electrode connected to the first node; and a fourth pixel transistor including a control electrode to receive an (n+1)-th gate signal, a first electrode to receive an initialization voltage, and a second electrode connected to the second node.

15. The display apparatus as claimed in claim 13, wherein the first and second pixel transistors and driving transistor of each of the plurality of pixel circuits are NMOS transistors.

16. The display apparatus as claimed in claim 9, wherein the n-th circuit stage includes a third signal generator to generate an n-th emission control signal using the n-th gate signal.

17. The display apparatus as claimed in claim 16, wherein the third signal generator includes:

a first T3 transistor to apply the n-th gate signal to a fifth control node based on a fourth clock signal different from the first, second and third clock signals, a second T3 transistor to output the first gate voltage as the n-th emission control signal based on a voltage of the fifth control node, and a third T3 transistor to output the second gate voltage as the n-th emission control signal based on the n-th gate signal.

18. The display apparatus as claimed in claim 17, wherein the third signal generator includes a fourth T3 transistor to apply the second gate voltage to the fifth control node based on the n-th gate signal.

19. The display apparatus as claimed in claim 17, wherein:

the second clock signal is to be delayed by one horizontal period from the first clock signal, the third clock signal is to be delayed by one horizontal period from the second clock signal, the fourth clock signal is to be delayed by one horizontal period from the third clock signal, and the first clock signal is to be delayed by one horizontal period from the fourth clock signal.

20. The display apparatus as claimed in claim 19, wherein the scan driver includes:

an (n−1)-th circuit stage, an n-th circuit stage, an (n+1)-th circuit stage, and an (n+2)-th circuit stage, the (n−1)-th circuit stage to generate an (n−1)-th gate signal synchronized with the first clock signal, the n-th circuit stage to generate an n-th gate signal synchronized with the second clock signal, the (n+1)-th circuit stage to generate an (n+1)-th gate signal synchronized with the third clock signal, and the (n+2)-th circuit stage to generate an (n+2)-th gate signal synchronized with the fourth clock signal.

* * * * *